US008979007B2

(12) United States Patent
Pallmann

(10) Patent No.: US 8,979,007 B2
(45) Date of Patent: Mar. 17, 2015

(54) DEVICE FOR COMMINUTION OF FEED MATERIAL

(75) Inventor: Hartmut Pallmann, Zweibruecken (DE)

(73) Assignee: Pallmann Maschinenfabric GmbH & Co. KG, Zweibruecken (DE)

( * ) Notice: Subject to any disclaimer, the term of this patent is extended or adjusted under 35 U.S.C. 154(b) by 856 days.

(21) Appl. No.: 13/230,275

(22) Filed: Sep. 12, 2011

(65) Prior Publication Data

US 2012/0061498 A1 Mar. 15, 2012

(30) Foreign Application Priority Data

Sep. 12, 2010 (DE) ..... 10 2010 045 125

(51) Int. Cl.

| | |
|---|---|
| ***B02C 18/22*** | (2006.01) |
| ***B02C 18/14*** | (2006.01) |
| *B02C 18/16* | (2006.01) |
| *B02C 18/18* | (2006.01) |
| *B02C 23/16* | (2006.01) |

(52) U.S. Cl.

CPC ..... *B02C 18/144* (2013.01); *B02C 2018/162* (2013.01); *B02C 2018/188* (2013.01); *B02C 2023/165* (2013.01)

USPC ..... 241/73; 241/242

(58) Field of Classification Search

USPC ..... 241/73, 242, 243

See application file for complete search history.

(56) References Cited

U.S. PATENT DOCUMENTS

2006/0118671 A1 6/2006 Astafan et al.

FOREIGN PATENT DOCUMENTS

DE 34 01 929 A1 8/1985

*Primary Examiner* — Mark Rosenbaum

(74) *Attorney, Agent, or Firm* — Muncy, Geissler, Olds & Lowe, P.C.

(57) ABSTRACT

A device for comminuting feed material is provided that has a housing including longitudinal walls and transverse walls for accommodating a rotor that rotates about a longitudinal axis. The rotor is equipped about its circumference with processing tools, and has, on its faces, an annular disk, each of which is concentric to the longitudinal axis. Within the housing, at least one screen path extends over a part of the circumference of the rotor, each screen path running at a slight radial distance from the annular disks while forming a seal gap. The feed material is supplied to the rotor through a feed shaft and is directed out of the device via a material discharge extending downstream of the screen path. In order to return material that emerges through the seal gap to the remaining material flow annular disks are each arranged with an axial clearance A from the transverse walls.

16 Claims, 4 Drawing Sheets

DEVICE FOR COMMINUTION OF FEED MATERIAL

This nonprovisional application claims priority under 35 U.S.C. §119(a) to German Patent Application No. DE 10 2010 045 125.8, which was filed in Germany on Sep. 12, 2010, and which is herein incorporated by reference.

BACKGROUND OF THE INVENTION

1. Field of the Invention

The invention relates to a device for comminuting feed material.

2. Description of the Background Art

Such devices belong to the field of mechanical process engineering, in particular the comminution of feed material in the manner of cutting, clipping, tearing, or crushing. But the dissociation of the bond of composite materials, which is always accompanied by a comminution of the feed material, also resides within the scope of the present invention. Generic devices consequently are suitable for the comminution of piece goods and bulk materials, in particular plastics with and without admixtures, wood, waste wood, paper, cardboard, cellulose, textiles, waste material, vulcanized rubber, natural rubber, resins, leather, foodstuffs, semi-luxury foodstuffs, fodder, minerals, pigments, dyes, pharmaceuticals, metals, composite materials such as electronic scrap, cables, used tires, and the like.

The basic principle of material processing is a result of the interaction of rotating cutting, shearing, or tearing tools with stationary tools or else from the impact energy of rapidly rotating striking tools such as hammers, plates, and the like, which crush the feed material. After it has been reduced sufficiently in size, the feed material is removed from the device through a screen, wherein the screen can additionally act as a comminution tool. Thus, the screen functionally subdivides the interior of the housing into an upstream comminution area and a downstream area for discharging the material that has already been comminuted.

In machines of this nature, the attachment of rotating machine parts to stationary machine parts proves to be problematic; in particular the attachment of the rotor to the housing proves to be a critical zone with regard to wear, heat buildup within the device, and quality of the end product.

Mills with a housing having longitudinal walls and transverse walls, in which a rotor extends from one transverse wall to the opposite transverse wall, are generally known. The rotor moving relative to the transverse wall during the course of comminution carries the feed material along in its circular path, which leads to considerable friction at the stationary transverse walls. The consequences are, firstly, wear on the inside of the housing wall and, secondly, an input of heat into the housing itself, since a portion of the supplied drive energy is converted into friction heat. This not only leads to additional thermal loading of the device, with the result that measures may need to be taken for cooling, but also leads to reduced energy efficiency. An example of such a device is disclosed in DE 34 01 929 A1.

In order to counter these problems, it is known to provide, on the faces of the rotor, an annular disk that rotates with the rotor and whose outer circumference extends radially past the comminution tools. The co-rotating annular disk prevents the feed material from coming into direct contact with the housing wall and causing wear and excessive heat there on its circular path. So that the feed material does not jam in the gap between the annular disk and the inside of the housing, the housing wall has a recess concentric to the annular disk into which the rotor extends with its annular disk. In this design, only a small radial annular gap is maintained between the outer circumference of the annular disk and the inner circumference of the recess. Thus, while the problem of wear of the housing inner wall is solved to a great extent in such an embodiment, it has nonetheless become apparent that fine feed material gets into the annular gap between the annular disk and the housing wall, and in this way the annular gap clogs in the course of time. In order to limit frictionally caused wear and heat development in the annular gap, it is necessary to clean it at regular time intervals, with the disadvantage that the expenditure of time required for this purpose increases the downtime of the device.

In order to remedy this problem, US 2006/0118671 A1 proposes forming the concentric recess in the housing walls over the entire thickness of the transverse wall, which is to say to produce a concentric opening in the housing wall within which the rotor is arranged with its rotating annular disk. The radial distance between the annular disk and the housing wall is chosen sufficiently small here that a sealing action arises with respect to the feed material. Nevertheless, during the course of comminution, especially fine particles get into the gap and reemerge on the outside of the housing. In order to capture and remove this material, in accordance with US 2006/0118671 A1 a metal duct is provided on the outside of the housing in the area of the gap.

It proves to be a disadvantage here that the material escaping from the outlet from the seal gap, and hence from the housing, is separated from the remaining flow of material by the transverse wall, and consequently must be recaptured by additional peripheral machine components and delivered to further processing, which entails additional structural and processing costs. From a static perspective, the transverse wall is structurally weakened by the large opening in which the annular disk is located, which impairs the stiffness of the machine construction. The opening also has the result that the rotor cannot be mounted on the transverse walls of the housing, the rotor instead having to be mounted directly on the substratum. The metal ducts attached to the transverse walls are not static load-bearing machine parts such as, e.g., the transverse walls, and consequently cannot be used for mounting the rotor. With regard to cleaning and maintenance that are as fast and effective as possible, the metal ducts on the outsides of the transverse walls only make for additional projections and corners that make such tasks more difficult.

SUMMARY OF THE INVENTION

It is therefore an object of the invention to improve conventional devices with regard to both structure and function.

A first advantage of the invention results from the structural feature of displacing the attachment region of the rotating rotors axially inward towards the center of the housing to stationary machine parts, such as to the screen path, specifically while simultaneously creating a free space between the housing and rotor. This measure remedies two serious disadvantages of the above-described prior art at once.

Firstly, material that gets through the seal gap is returned to the remaining material flow directly and without additional provisions. Consequently, a device according to the invention is characterized by a simplified machine construction and, at the same time, reduced operating expense. Secondly, the thermal problems that have hitherto been known are eliminated by the air gap in the free space between the housing wall and the rotor. The air gap represents thermal insulation for the transverse wall, which consequently no longer heats up as strongly. As a result, temperature-related problems occur to a far lesser degree in an device according to the invention. In an advantageous refinement of this concept, cooling air can flow through the free space, the cooling air being supplied through openings in the housing, for example. In the event that the air flows through the free space from the top to the bottom, the cooling air additionally supports the flow of material.

The transverse walls represent structurally load-bearing parts, for which the bearing of static and dynamic loads is an important function. By displacing the seal gap axially inward from the plane of the transverse wall (US 2006/0118671 A1), the transverse wall can remain without structural weakening, and thus can serve better for load bearing.

In carrying this concept further, the transverse walls of a device according to the invention can accomplish the mounting of the rotor, for example in that support brackets are attached to the outsides of the transverse walls. This results in an extremely compact construction in which all important components are within or attached to the housing.

It proves to be an advantage if the transverse walls are connected to one another in a deflection-resistant manner by longitudinal profiles, thus forming a stiff supporting frame. This allows for doors to be installed in the longitudinal sides of the device, through which accessibility to the interior of the housing is ensured.

It is advantageous for the free space to be closed at both sides and at the top. The surfaces delimiting the free space in this design can be composed of the longitudinal walls and the cover plate, for example. At the top, the closure to the clearance surrounding the upper circumferential section can also be composed of a shaped part, which is located between the metal wearing plate and the transverse wall for the purpose of attachment of the metal wearing plate on the face side. In this way, the material escaping from the seal gap is collected and reunited with the flow of material in a targeted manner.

So as not to impede the material flow within the free space, yet also to protect the transverse walls from excessive heat radiation, it is necessary for there to be a minimum distance between the annular disks of the rotor and the associated transverse walls. In this context, distances of at least 2 cm, preferably at least 3 cm or 5 cm, have proven to be advantageous.

The seal gap running around the annular disks must satisfy two requirements. On the one hand, it is necessary to prevent feed material that has not been properly reduced in size from getting into the material discharge, for which purpose the seal gap cannot exceed a certain width. On the other hand, the most unhindered possible rotation of the rotor with respect to stationary machine parts, such as the screen paths, must be ensured, which requires a minimum width of the seal gap. In order to satisfy these fundamentally conflicting requirements, the invention provides for a maximum width of the seal gap of 3 mm, preferably a maximum of 1 mm or 0.5 mm.

In this regard, the smaller the installation tolerances of the machine components forming the seal gap are, the narrower it is possible to make the seal gap. In this context, the invention provides for installation of the screens on the associated screen support frame in which the screens are not only clamped, but also their backs are simultaneously braced against the screen support frame. Since the screen support frame determines the precise nominal geometry, it is ensured in this manner that the screen paths also have the desired geometry over the entire length of the seal gap, and the width of the seal gap can be minimized.

In order to increase the efficiency of a device according to the invention, the screen paths extend as a whole over at least half the rotor circumference, for example over two-thirds thereof. In order to ensure a precise fit of the screens on the screen support frame over the entire intended circumferential section, it is advantageous here for the rotor to be surrounded by two or more screen paths.

The invention is explained in detail below with reference to an exemplary embodiment in the form of a cutting mill shown in the drawings. Since the exemplary embodiment is not to be understood as limiting, devices of similar construction and based on the same principle of operation, such as drum shredders, beating mills, and the like, also reside within the scope of the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
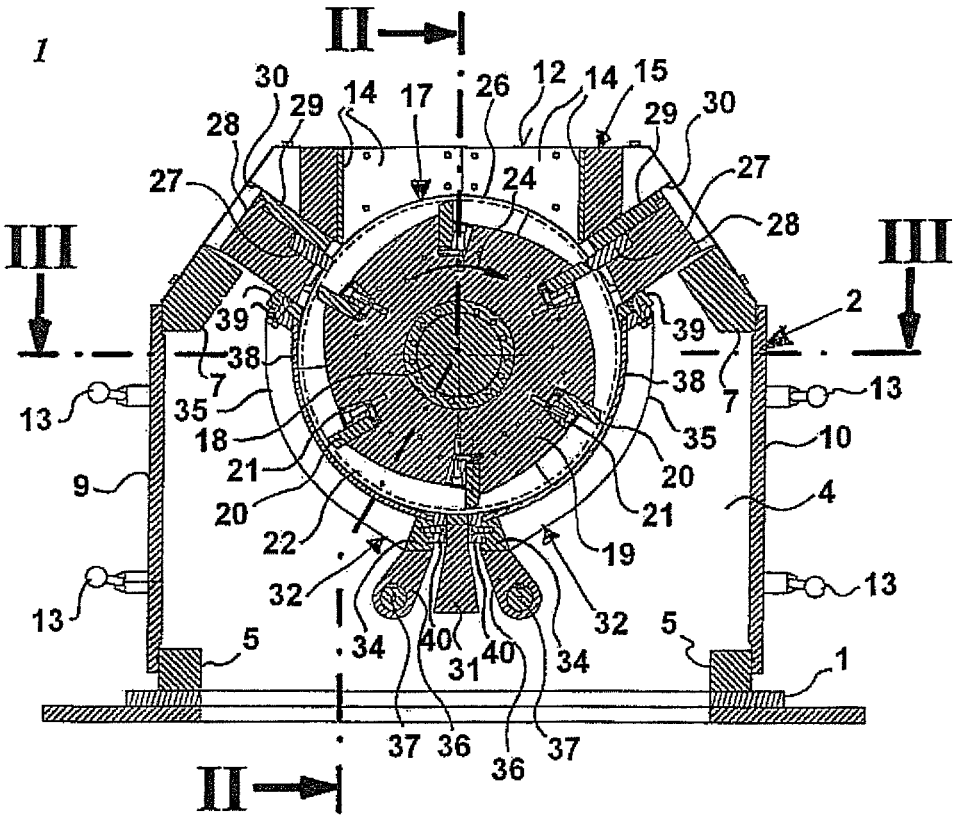
FIG. 1 is a cross-section through an inventive device along the line I-I shown in FIGS. 2 and 3.

The more precise structure of the inventive device is evident from FIGS. 1 through 4, which show a cutting mill. The cutting mill has, resting on a substructure labeled 1, a housing 2 which is composed essentially of two opposing, plane-parallel transverse walls 3 and 4, whose outline is rectangular in the bottom region and trapezoidal in the top region (FIG. 1). The transverse walls 3 and 4 are structurally load-bearing parts, which are frictionally connected to one another at their base region by one longitudinal spar 5 on each side. In the transition region between the rectangular region and the trapezoidal region, longitudinal spars 7, which likewise are axially parallel, reinforce the housing construction, with the overall result of a stiff supporting frame. Each of the longitudinal sides of the housing 2 are closed off by longitudinal walls 9 and 10, which can pivot about a vertical axis by means of hinges 11 after the lock 13 has been released in order to ensure accessibility to the interior of the housing.

The top of the housing 2 has a rectangular opening 12, which continues in the housing interior as a vertical feed shaft 15 with a rectangular cross-section, and leads to the region of action of a rotor 17 that rotates about a longitudinal axis 16 and is centrally located in the housing 2. The sides of the feed shaft 15 are covered with metal wearing plates 14. The regions of the housing top that are located outside of the feed shaft 15 are sealed off with cover plates 47, which rest on the housing walls (see primarily FIGS. 1 and 2). The lower region of the housing 2 constitutes a material discharge 33, and is open to the bottom.

Figure 2:
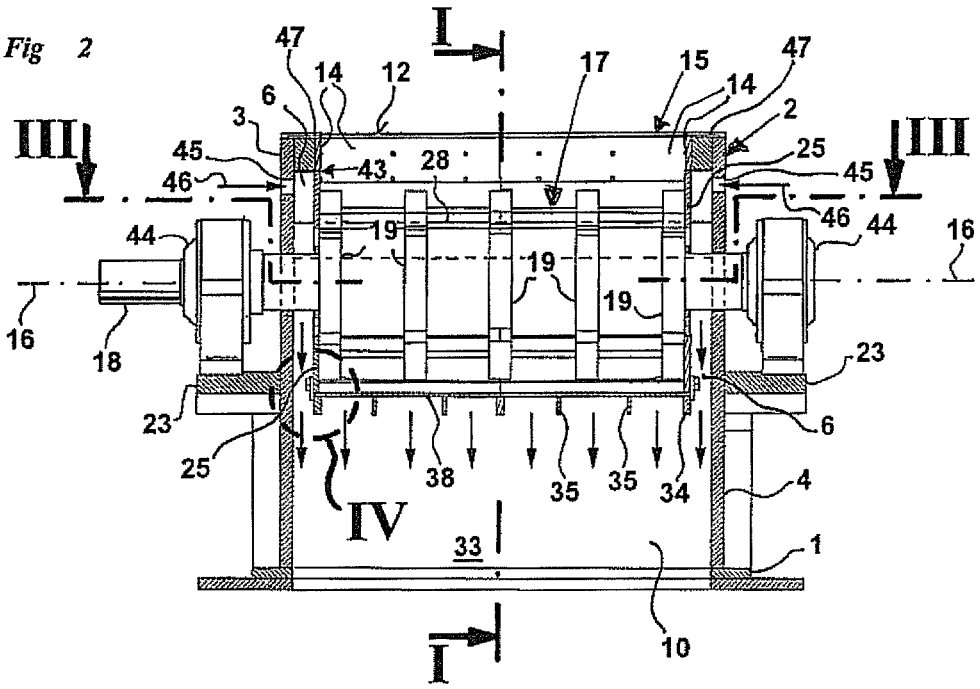
FIG. 2 is a longitudinal section through an inventive device along the line II-II shown in FIG. 1.

As is also evident from FIGS. 1 and 2, the rotor 17 comprises a drive shaft 18, on which are mounted, in a rotationally fixed manner, rotor disks 19 that are arranged coaxially to one another and axially spaced apart. Evenly distributed about their circumference, the rotor disks 19 have radial edge recesses that are intended to accommodate axially parallel blade strips 20. The blade strips 20 are fixed in the edge recesses by means of radially tensioned clamping wedges 21 in such a manner that the cutting edges 8 of the blade strips 20 lie on a common cutting edge circle 22.

Figure 3:
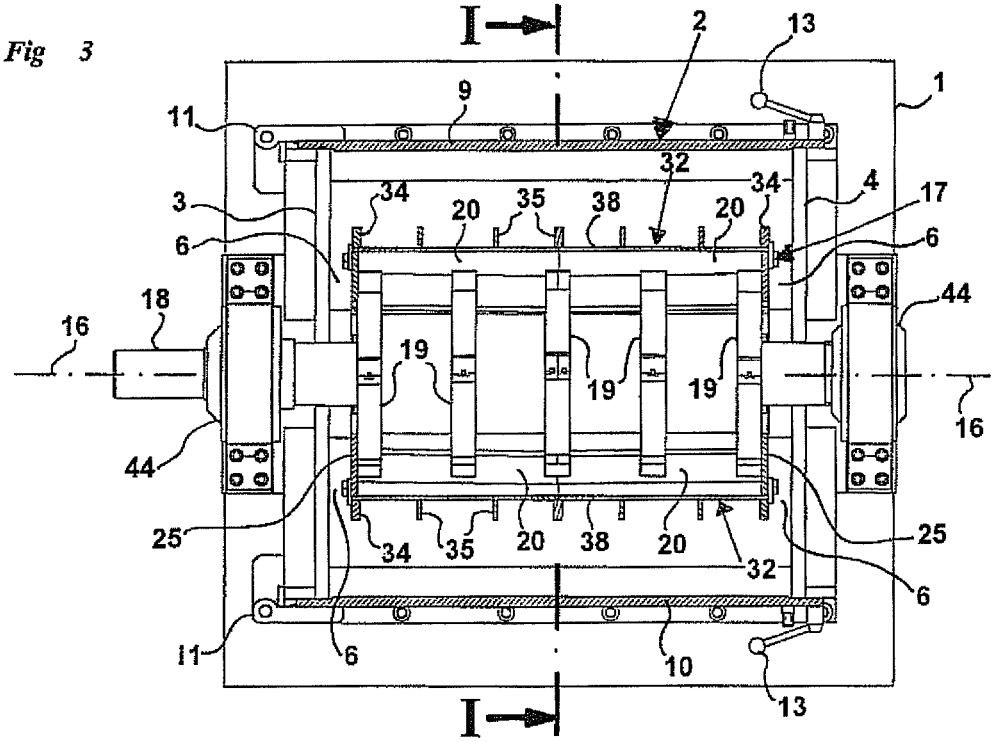
FIG. 3 is a horizontal section through an inventive device along the line III-III shown in FIGS. 1 and 2.

It is apparent from FIGS. 2 and 3 that the ends of the drive shaft 17 pass through the transverse walls 3 and 4, and are rotatably mounted outside the housing 2 in shaft bearings 44. To this end, brackets 23, upon which the shaft bearings 44 rest at an axial distance from the transverse walls 3 and 4, are welded to the outside of the transverse walls 3 and 4. The weight of the rotor and dynamic forces are conducted away from the transverse walls 3 and 4. By means of a drive that is not shown in detail, the drive shaft 18, and hence the entire rotor 17, is set in rotation. The direction of rotation is indicated by the arrow 24 in FIG. 1.

Figure 4:
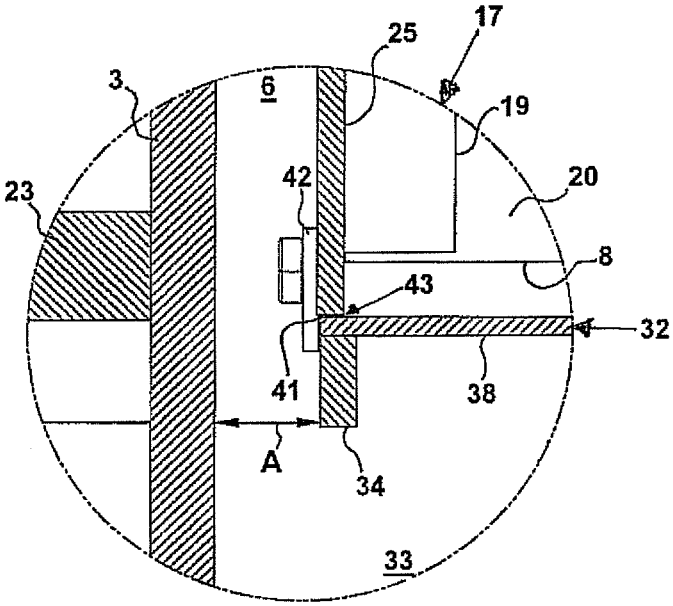
FIG. 4 is a detail of the area IV marked in FIG. 2.

The face ends of the rotor 17 are composed of annular disks 25 concentric to the axis 16, which in the present example are composed of three annular segments that each have a circumferential section of 120° and are axially screwed to the first and last rotor disk 19. The outside diameter of the annular disks 25 is greater than the diameter of the cutting edge circle 22 here. In FIGS. 1 and 4, the outside circumference of the annular disk 25 is labeled 26. FIG. 2 discloses that the metal wearing plates 14 of the feed shaft 15 are recessed in the region of the annular disks 25, and the annular disks 16 are arranged within the recesses, wherein their outer circumference 26 is located a short radial distance opposite the metal wearing plates 14, and in this way form a seal gap 43. The wear plates 14 on the face side and the annular disks 25 or 26 consequently lie essentially in one plane.

As is evident from FIG. 1, in the circumferential region of the rotor 17, stator blades 27 are arranged directly laterally to the two longitudinal sides of the feed shaft 15; these blades extend across the entire axial length of the rotor 17 and their cutting edges 8 are opposite the blade strips 20 of the rotor 17 while maintaining a radial blade clearance. The stator blades 27 are attached to the housing 2 by means of clamping bars 28, likewise axially parallel, which extend from the transverse wall 3 to the transverse wall 4 where they are removably attached and mounted in receiving slots 30. The stator blades are braced against the clamping bars 28 by means of clamping plates 29.

Radially opposite the rotor 17 at the lower apex is another axially parallel longitudinal spar 31, which adjoins the transverse walls 3 and 4 in a deflection-resistant manner for reinforcement of the housing 2. The circumferential sections between the two clamping bars 28 and the longitudinal spar 31 are each covered by a curved screen path 32, which extends in the axial direction over the entire length of the rotor 17 to the outsides of the annular disks 25 and 26, and maintains an axial clearance from each of the transverse walls 3 and 4. Together, the two screen paths 32 cover more than two thirds of the rotor circumference in this way.

Each screen path 32 is composed essentially of a screen support frame 34, which is reinforced by curved ribs 35. Welded to the screen support frame 34 in the region of the longitudinal spar 31 are legs 36, the free ends of which sit on a shaft 37 in a rotationally fixed manner. The shafts 37 run parallel to the longitudinal spar 31, and in order to fold up the screen elements 32, their ends are coupled to a rotary drive, which is not shown.

On the inside facing the rotor 17, screen support frames 34 and ribs 35 are each fitted with perforated plates 38. For the purpose of precisely positioned securing of the perforated plates 38, their top and bottom edges in the circumferential direction are braced against one another by means of clamping strips 39 and 40. The force vector of the clamping force thus exerted has both a radial and a tangential component in the direction of the opposite screen edge. In this way, it is ensured that the perforated plates 38 fit precisely against the inside circumference of the screen support frame 34 and the ribs 35.

As a result of this type of construction, a closed region is created within the housing 2 that, in the radial direction, is delimited by the longitudinal walls of the feed shaft 15, the clamping bars 28, the screen paths 32, and the longitudinal spar 31, and in the axial direction by the two rotating annular disks 25 and the walls of the feed shaft 15 composed of the metal wearing plates 14 on the face side. In terms of process technology, the said machine parts thus constitute a separation, wherein the region upstream of the separation is devoted to active comminution of the feed material, while the region located downstream of the separation serves the discharge of the comminuted material out of the device via the material discharge 33.

Very important in this context is the attachment of rotating machine parts, namely the annular disks 25, to stationary machine parts, here primarily to the screen paths 32 and the face-side metal wearing plates 14. On the one hand, it is necessary to ensure that feed material in this region that is only insufficiently reduced in size does not reach the discharge region of the device by circumventing the screen path 32, which calls for a relatively narrow gap. On the other hand, the gap between rotating and stationary machine parts cannot be so small that the rotary movement of the rotor is impaired by it or that the development of heat due to friction is excessive.

FIG. 4 shows this region in a larger scale. Of the rotor 17, one can see a part of the end rotor disk 19, whose outside circumference bears a blade strip 20, whose cutting edge in turn is labeled with reference number 8. Coaxially attached to the outside of the rotor disk 19 is the annular disk 25, whose outside circumference 41 projects radially past the cutting edge 8 of the blade strip 20. Screwed to the outside of the annular disk 25, in turn, is a bar-shaped clearing tool 42, which extends radially past the outside circumference 41 of the annular disk 25.

In the radial direction, the annular disk 25 is located opposite the perforated plate 38 resting on the screen support frame 34 of the screen path 32, wherein a small radial seal gap 43 with a width from 0.5 mm to 3 mm, preferably 1 mm, is maintained between the outside circumference 41 of the annular disk 25 and the perforated plate 38. The width of the seal gap 43 depends essentially on the type of feed material, the type of comminution, and the desired fineness, as well as the requisite clearance for the rotary motion of the rotor 17. The clearing tool 42 extends radially beyond the seal gap 43, and in doing so captures fine feed material that gets through the seal gap 43 and in this way prevents clogging of the seal gap 43.

In the axial clearance, a transverse wall 3 is located opposite the annular disk 25 and the screen element 32; the part of the bracket 23 for the shaft bearing 44 is visible on the outside of this transverse wall. The clearance distance is at least 1 cm, preferably at least 2 cm or at least 3 cm. In the present example, the cutting mill even has a distance of 5 cm, which can be even larger if necessary. A sufficient distance ensures that no accumulations of material collect in the free space 6, which would hinder free flow, and the thermal load on the transverse walls is reduced.

As a result of the clearance between the transverse wall 3 and annular disk 25, a disk-shaped free space 6 is produced in accordance with the invention; radially toward the bottom, this free space transitions directly into the material discharge 33 of the device. The free space 6 advantageously extends over at least the entire part length of the seal gap 43 in the region of the screen paths 32, which is to say that all material that emerges from the gap 43 between the annular disk 25 and screen paths 32 is captured in the free space 6. However, the free space 6 can also extend over the entire circumference of the seal gap 43, which is to say also over the region of the feed shaft 15. The free space 6 is delimited at the sides essentially by the longitudinal walls 9 and 10, and at the top by the cover plates in this region. The width of the free space 6 thus corresponds essentially to the width of the transverse walls 3 and 4. The free space 6 is thus closed off at the top and at the sides, and is only open at the bottom in the direction of the material discharge 33. In this design, the drive shaft 18 passes through the free space 6, with the free space surrounding the drive shaft in an approximately annular shape.

With the aid of the free space 6, feed material that gets through the seal gap 43 axially is redirected in the radial direction in the free space 6, and is fed directly and without further measures to the material flow downstream of the screen elements 32.

As is shown primarily in FIG. 2, the transverse walls 3 and 4 can each have one or more openings 45, which open into the free space 6 from outside, and by means of which the free space 6 can be subjected to an airflow 46. The airflow 46 can serve to cool the device, but can simultaneously also support the material flow within the free space 6 and additionally in the material discharge 33.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for comminuting feed material, the device comprising:

a housing having longitudinal walls and transverse walls for accommodating a rotor that rotates about a longitudinal axis, the rotor being equipped about its circumference with processing tools, and to each end face of the rotor, an annular disk is attached concentrically to the longitudinal axis; and at least one screen path that extends inside the housing over a part of the circumference of the rotor, the screen path running at a slight radial distance from the annular disks while forming a seal gap, wherein the feed material is supplied to the rotor through a feed shaft and is directed out of the device via a material discharge downstream of the screen path, and wherein the annular disks are each arranged with an axial clearance A from the transverse walls in order to form a free space.

2. The device according to claim 1, wherein the axial clearance A is at least 2 cm.

3. The device according to claim 1, wherein the free space inside the housing opens directly into the material discharge in the radial direction.

4. The device according to claim 1, wherein the free space is closed off at the sides and at the top.

5. The device according to claim 1, wherein clearing tools that extend radially across the outside circumference of the annular disks are located on each end face of the rotor.

6. The device according to claim 1, wherein air flows through the free space from the top to the bottom.

7. The device according to claim 1, wherein the seal gap has a maximum radial width of 3 mm.

8. The device according to claim 1, wherein the screen path comprises perforated plates, which are secured to a screen support frame, and wherein the screen support frame has clamping strips that clamp the axially parallel edges of the perforated plates.

9. The device according to claim 1, wherein the rotor is surrounded by two screen paths that follow one another in the direction of rotation.

10. The device according to claim 9, wherein the screen paths together extend over at least half the circumference of the rotor or over at least two-thirds thereof.

11. The device according to claim 1, wherein the two transverse walls are connectable to one another via longitudinal profiles to form a supporting frame.

12. The device according to claim 1, wherein two shaft bearings are attached to the transverse walls.

13. The device according to claim 1, wherein the axial clearance A is at least 3 cm.

14. The device according to claim 1, wherein the axial clearance A is at least 5 cm.

15. The device according to claim 1, wherein the seal gap has a maximum radial width of 1 mm.

16. The device according to claim 1, wherein the seal gap has a maximum radial width of 0.5 mm.

* * * * *